US007530122B2

(12) United States Patent
Schaaf

(10) Patent No.: US 7,530,122 B2
(45) Date of Patent: May 12, 2009

(54) APPARATUS FOR WASTE LINE CLEANOUT

(76) Inventor: Craig R. Schaaf, 806 Coutant, Flushing, MI (US) 48433

( * ) Notice: Subject to any disclaimer, the term of this patent is extended or adjusted under 35 U.S.C. 154(b) by 637 days.

(21) Appl. No.: 10/874,635

(22) Filed: Jun. 23, 2004

(65) Prior Publication Data

US 2005/0283890 A1 Dec. 29, 2005

(51) Int. Cl.
*E03D 9/00* (2006.01)

(52) U.S. Cl. ..... 4/255.1; 138/90; 222/519; 222/537

(58) Field of Classification Search ..... 4/255.01, 4/255.06, 255.12, 255.04, 255.08; 15/104.05–104.062; 138/90; 222/519, 522, 537, 568
See application file for complete search history.

(56) References Cited

U.S. PATENT DOCUMENTS

| | | | | |
|---|---|---|---|---|
| 36,478 | A * | 9/1862 | Phelps | 222/519 X |
| 582,148 | A * | 5/1897 | Rollins | 138/90 |
| 1,554,410 | A * | 9/1925 | Cooke | 222/519 |
| 2,413,997 | A * | 1/1947 | Rosa | 134/167 C |
| 3,951,441 | A | 4/1976 | Scheuer et al. | |
| 3,993,102 | A | 11/1976 | Polster et al. | |
| 4,159,721 | A | 7/1979 | Horter | |
| 4,259,983 | A | 4/1981 | Kessel | |
| 4,360,041 | A | 11/1982 | Hagan et al. | |
| 4,614,065 | A | 9/1986 | Papp | |
| 4,686,732 | A | 8/1987 | Irwin | |
| 4,932,686 | A * | 6/1990 | Anderson, Jr. | 285/24 |
| 5,107,550 | A | 4/1992 | Hawro et al. | |
| 5,144,699 | A * | 9/1992 | Graham | 4/256.1 |
| 5,651,147 | A | 7/1997 | Steele et al. | |
| 5,921,580 | A * | 7/1999 | Dyer | 283/32 |
| 5,947,156 | A * | 9/1999 | Tomczyk | 137/899 |
| 6,941,589 | B1 * | 9/2005 | Dural et al. | 4/255.01 |

* cited by examiner

*Primary Examiner*—Robert M Fetsuga
(74) *Attorney, Agent, or Firm*—Robert L. McKellar; McKellar IP Law, PLLC

(57) ABSTRACT

A system for the controlled release of backed up waste water from a restricted waste line and/or for facile pressure clearing of a restricted waste line. The apparatus of the instant invention can be installed in a wye cleanout fitting and positioned so that the seal is positioned near and sealed in the cleanout plug passageway of the wye cleanout fitting. Then the valve can be opened to controllably drain the waste line.

2 Claims, 6 Drawing Sheets

APPARATUS FOR WASTE LINE CLEANOUT

BACKGROUND

The instant invention is in the field of plumbing apparatus and more specifically the instant invention is in the field of plumbing apparatus for draining and cleaning waste lines.

The plumbing system of a building usually has pressurized hot and cold water lines and gravity flow waste lines. A "cleanout" is typically installed at the end of each horizontal run of waste line plumbing. The cleanout usually consists of a wye fitting having a threaded plug in line with the horizontal run of waste line plumbing. If the horizontal run of waste line plumbing becomes restricted, then the threaded plug can be removed so that, for example, a plumbers "snake" can be run down the waste line to clear the restriction.

Clogged waste lines hold water with a volume and pressure that is unpredictable and even uncontainable upon removal of the threaded plug of the cleanout fitting. Once the cleanout plug is removed, the entire drainage system above the cleanout is released. Clean up of such a release can take longer than clearing the restriction in the waste line. Thus, it would be an advance in the plumbing art if a system were devised that provided for a controlled release of backed up waste water from a restricted waste line and/or for facile pressure clearing of a restricted waste line.

SUMMARY OF THE INVENTION

The instant invention is an apparatus providing a solution to the above stated problems. The instant invention provides a system for the controlled release of backed up waste water from a restricted waste line and/or for facile pressure clearing of a restricted waste line. More specifically, the instant invention comprises four elements. The first element is a pipe. The second element is a valve attached to one end of the pipe and in fluid communication therewith. The third element is a seal having a bore therethrough, the pipe positioned in and sealed to the bore of the seal. The fourth element is a first pipe connector having a bore therethrough, the pipe positioned through and sealed to the bore of the first pipe connector at a position of the pipe between the valve and the seal.

When the apparatus of the instant invention is installed in a wye cleanout fitting and positioned so that the seal is positioned near and sealed in the cleanout plug passageway of the wye cleanout fitting, then the valve of the instant invention can be opened to controllably drain the waste line. When the apparatus of the instant invention is installed in a wye cleanout fitting and positioned so that the seal is positioned near and sealed in the horizontal waste line passageway of the wye cleanout fitting, then pressurized water can be flowed through the valve of the instant invention to clear the restriction in the waste line. The apparatus of the instant invention can also be installed in a wye fitting installed in a waste line so that a portion of the waste line can be isolated when the seal is positioned in the crotch of the wye fitting.

DETAILED DESCRIPTION OF THE INVENTION

Figure 1:
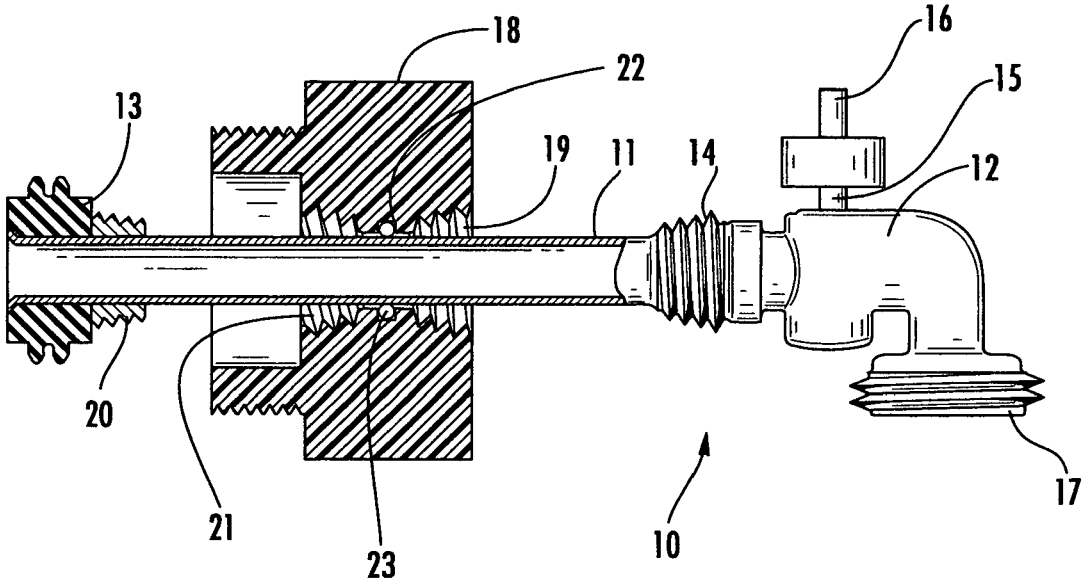
FIG. 1 is a side view, part in full and part in cross-section, of a preferred embodiment of the instant invention employing a ribbed cylinder shaped rubber sealing element.

Referring now to FIG. 1, therein is shown a side view, part in full and part in cross-section, of a preferred apparatus 10 of the instant invention including a one half inch internal diameter, five eights inch outside diameter copper pipe 11. The pipe 11 is attached at one end thereof to ball valve 12. The other end of the pipe 11 is positioned in and sealed in the bore of a ribbed bulbous cylinder shaped rubber seal 13, i.e. a bored sphere. The pipe 11 is flared at retain the seal 13 on the pipe 11. The pipe 11 is positioned through and sealed to the bore of a first pipe fitting 14 having external threads thereon, said threads being substantially coaxial with said bore. The valve 12 has a valve stem 15, a valve handle 16 and an outlet 17 threaded for a rubber hose connection.

Referring still to FIG. 1, the pipe 11 is positioned in the bore of a bushing 18. The bore of the bushing 18 has a threaded portion 19 dimensioned to engage with the external threads of the first pipe fitting 14. The pipe 11 is also positioned in and sealed to the bore of a second pipe fitting 20 having external threads thereon substantially coaxial with said bore. The threads of the second pipe fitting 20 are dimensioned to engage with a second threaded portion 21 of the bore of the bushing 18. A gland 22 retains an o-ring 23 to seal the pipe 11 to the bushing 18.

Figure 4:
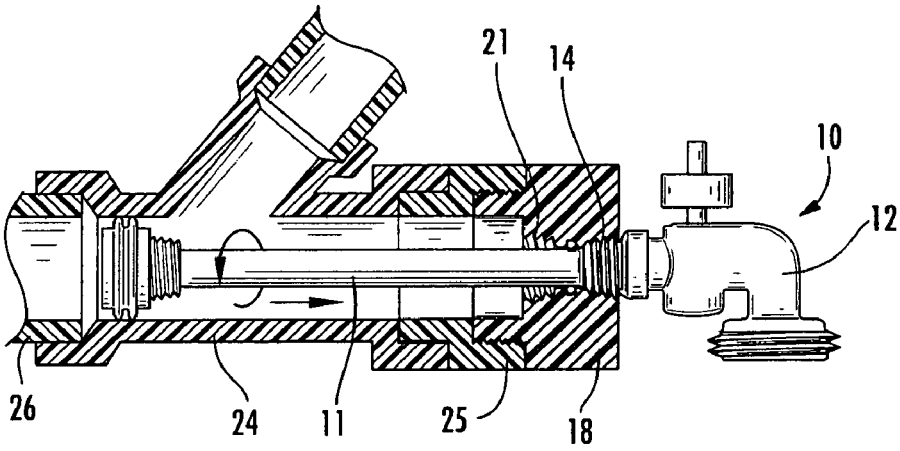
FIG. 4 is a side view, part in full and part in cross-section, of the installation of the apparatus of FIG. 1 in a cleanout wye in position for draining a waste line.

Referring now to FIG. 4, therein is shown a side view, part in full and part in cross-section, of the installation of the apparatus 10 of FIG. 1 in a cleanout wye 24 having a threaded adapter 25 in position for draining waste line 26 by opening the valve 12 to controllably drain the waste water into a bucket, not shown. The apparatus 10 is placed in the position shown in FIG. 4 by withdrawing the apparatus 10 from the bushing 18 and then rotating the apparatus 10 in a counter clock wise manner so that the threads of the second pipe connector 20 engage the corresponding threads in the bore of the bushing 18. The outside diameter of the ribs of the seal 13 are dimensioned to be a compression fit in the inside diameter of the wye 24.

Figure 3:
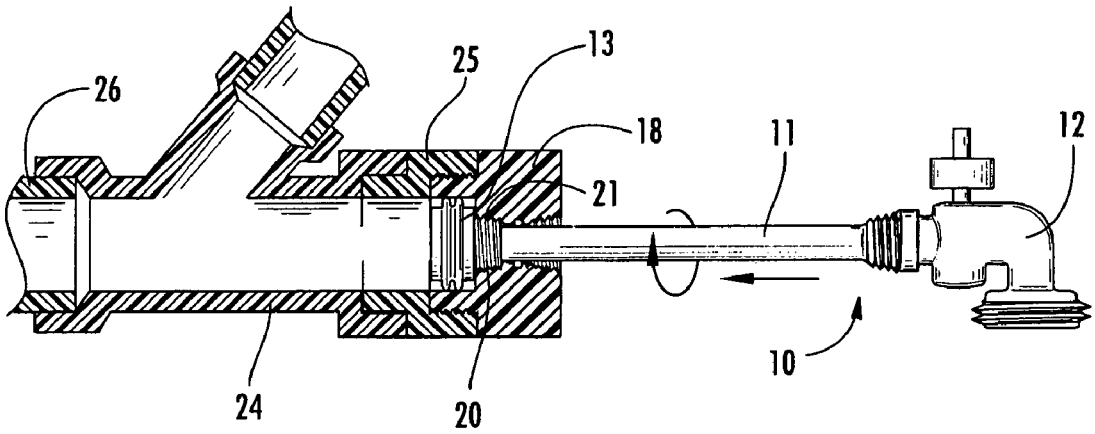
FIG. 3 is a side view, part in full and part in cross-section, of the installation of the apparatus of FIG. 1 in a cleanout wye in position for pressure cleaning of a waste line.
Figure 6:
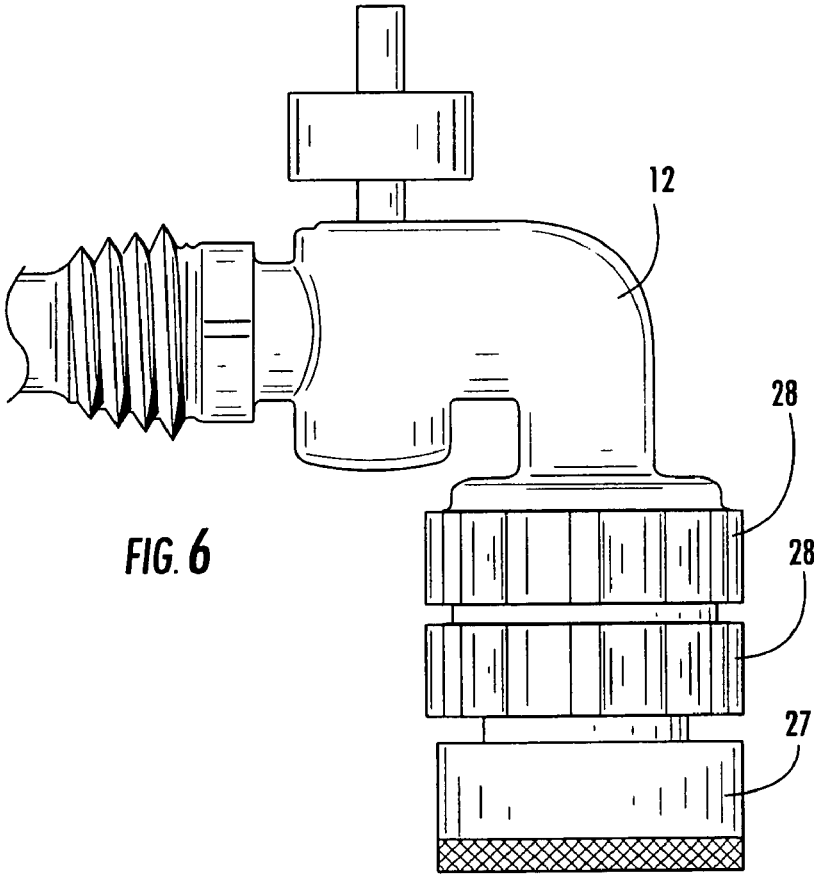
FIG. 6 shows the installation of a hose adapter and anti-siphon device on the valve of the instant invention.

Referring now to FIG. 3, therein is shown a side view, part in full and part in cross-section, of the installation of the apparatus 10 of FIG. 1 in a cleanout wye 24 having a threaded adapter 25 in position for pressure cleaning waste line 26 by attaching a pressurized water rubber hose to valve 12 and then opening valve 12. Alternatively, a partial vacuum can be applied to waste line 26 by attaching a vacuum hose to valve 12. The apparatus 10 is placed in the position shown in FIG. 3 by sliding the apparatus 10 into the bushing 18 and then rotating the apparatus 10 in a clock wise manner so that the threads of the first pipe connector 14 engage the corresponding threads in the bore of the bushing 18. Referring now to FIG. 6, when a rubber hose is connected to the valve 12, code requires an anti-siphon device 27 which can be adapted to the valve 12 by way of a female/female rubber hose adapter 28.

Figure 2:
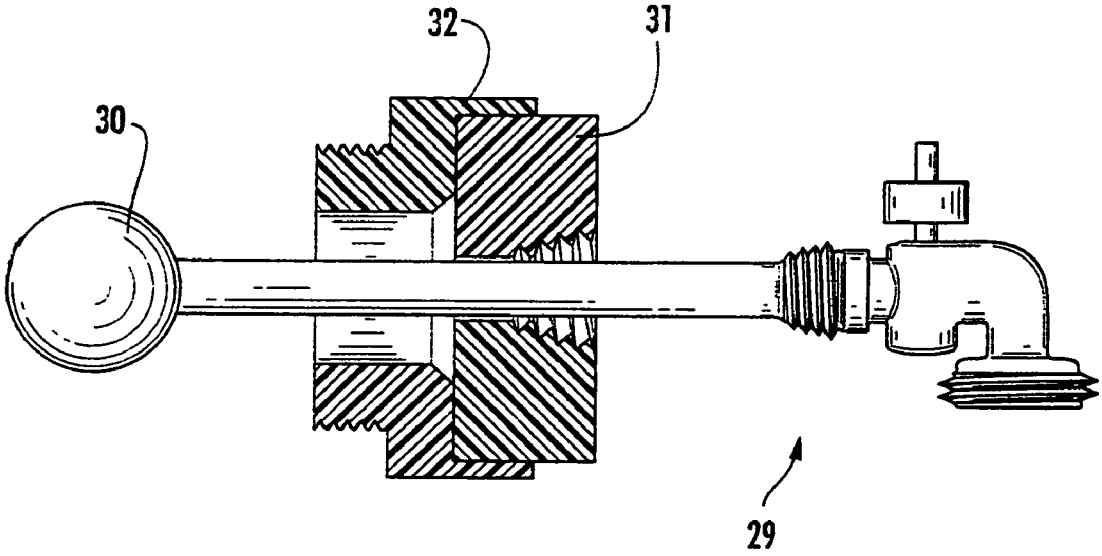
FIG. 2 is a side view, part in full and part in cross-section, of another embodiment of the instant invention employing a spherical shaped rubber sealing element.

Referring now to FIG. 2, therein is shown a side view, part in full and part in cross-section, of another apparatus 29 of the instant invention similar to the embodiment 10 of FIG. 1 but employing a spherical shaped rubber sealing element 30 and no second pipe connector . In addition, the apparatus shown in FIG. 2 uses an industry standard one and one half inch male adapter 32 and an industry standard one and one half by one half inch national pipe thread bushing 31. There is no O-ring seal used in the bushing 31. The apparatus shown in FIG. 2 can be used in much the same way as the apparatus shown in FIG. 1. In addition, the apparatus shown in FIG. 2 can be used as shown in FIG. 5.

Figure 5:
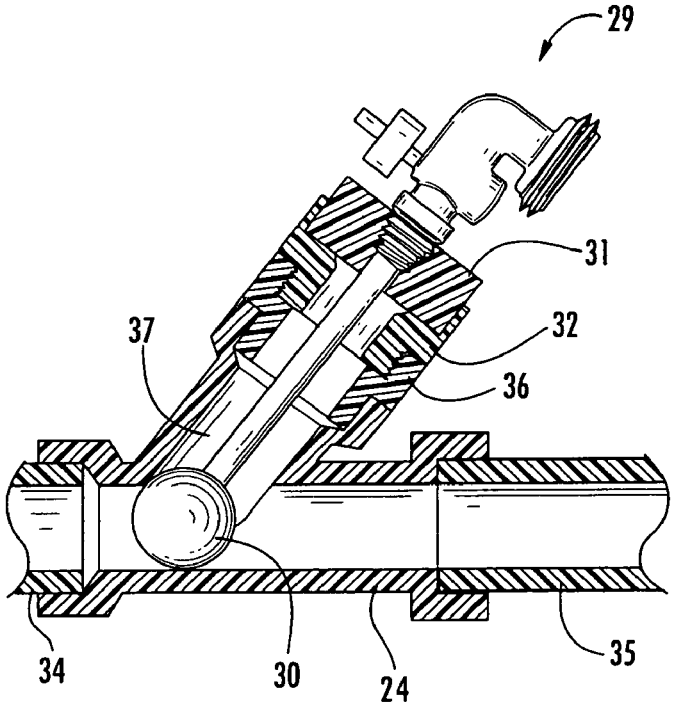
FIG. 5 is a side view, part in full and part in cross-section, of the installation of the apparatus of FIG. 2 in a wye installed in a waste line, the apparatus being in position to isolate a portion of the waste line.

Referring now to FIG. 5, therein is shown a side view, part in full and part in cross-section, of the installation of the apparatus of FIG. 2 in a wye 24 installed in a waste line in position to isolate one portion 34 of the waste line from the other portion 35 of the waste line. The apparatus shown in FIG. 2 is installed in the wye 24 by way of a threaded adapter 36. The apparatus 29 is placed in the position shown in FIG. 5 by sliding the apparatus 29 into the bushing 31 and then rotating the apparatus 29 in a clock wise manner so that the threads of the first pipe connector of the apparatus 29 engage the corresponding threads in the bore of the bushing 31 so that the spherical shaped rubber sealing element 30 is sealed in the crotch of the wye fitting to isolate the one portion 34 of the waste line from the other portion 35 of the waste line. Of course, the apparatus 29 can also be used to drain or flush the waste line in the position shown in FIG. 5 as well as if the apparatus 29 is placed in a withdrawn position with spherical shaped rubber sealing element 30 sealed in the blind bore 37 of the wye 33.

Figure 7:
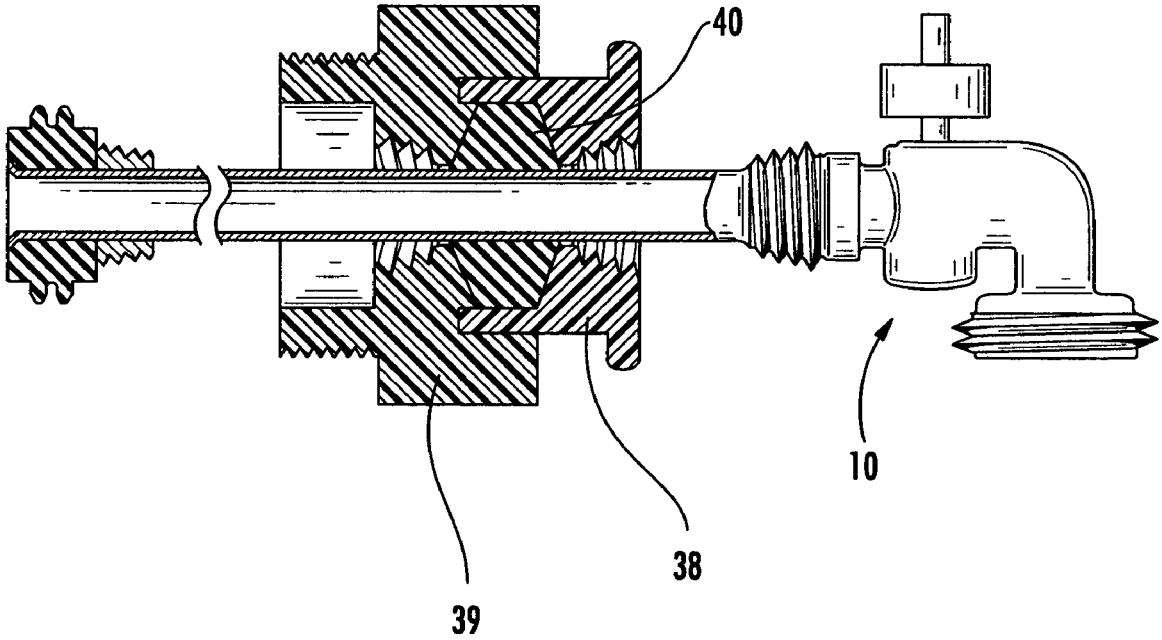
FIG. 7 is a side view, part in full and part in cross-section, of another preferred embodiment of the instant invention.
Figure 8:
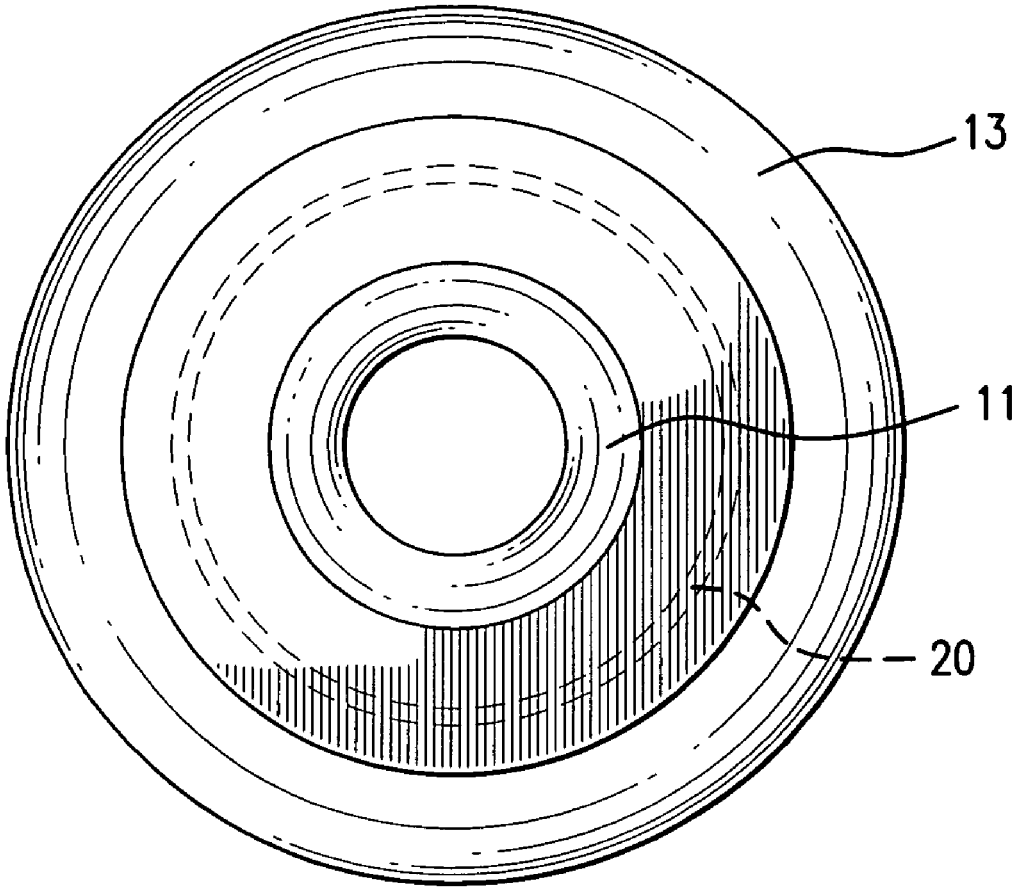
FIG. 8 is an end view of the seal designated 13 in FIG. 1.

Referring now to FIG. 7, therein is shown a side view, part in full and part in cross-section, of another preferred embodiment of the instant invention using the apparatus 10 of FIG. 1 installed in a PVC bushing 38, a PVC fitting 39 and a rubber ring 40. The use of the rubber ring 40 is more preferred than the use of the O-ring 23 of FIG. 1.

The seal of the instant invention can be of any suitable shape even though the shapes disclosed above are preferred. Preferably, the seal of the instant invention is a resilient seal comprising an elastomer such as neoprene or silicone rubber. However, a ball shaped PVC seal, for example, dimensioned to be slightly larger in diameter than the internal diameter of a cleanout wye can be used as the seal of the instant invention. The seal of the instant invention is preferably mounted at the end of the pipe away from the valve.

The valve of the instant invention is preferably a ball valve but can be any type of valve such as a gate valve. The first pipe fitting of the instant invention is preferably integral with the valve, i.e., a "boiler drain" valve. When a brass boiler drain valve is used with a copper pipe in the instant invention, then it is preferable to solder the pipe in the first pipe fitting of the boiler drain valve. However, it should be understood that the first pipe fitting need not be integral with the valve and need not be positioned at the end of the pipe.

The use of a second pipe fitting is preferred in the instant invention to help retain the seal in position of the pipe and to better retain the apparatus of the instant invention in the bushing in the position shown in FIG. 4. Although not necessary in the instant invention, it is preferred to use an O-ring to seal the pipe with the bushing. The pipe of the instant invention can be made of any suitable material such as polyvinylchloride (PVC), iron, galvanized iron or copper. It is contemplated that the pipe, pipe fitting(s) and valve body of the instant invention can be integral and molded of PVC.

Preferably, the external threads on the first and second pipe fittings are perfectly or essentially coaxial with the longitudinal-axis of the pipe. However, of course, the external threads on the first and second pipe fittings can be substantially coaxial with the longitudinal axis of the pipe, i.e., sufficiently coaxial to permit rotation of the apparatus of the instant invention when it is threaded into position as shown in FIGS. 3, 4 and 5. The first pipe connector of the instant invention is preferably an externally threaded pipe fitting. However, the first pipe connector of the instant invention can be other connectors such as a quick-disconnect fitting or a bayonet fitting.

In conclusion, it is readily apparent that although the invention has been described above in detail in relation with its preferred embodiments, it should be understood that the instant invention is not limited thereby but is intended to cover all alternatives, modifications and equivalents that are included within the scope of the invention as defined by the following claims.

What is claimed is:

1. Apparatus suitable for use in waste line plumbing applications, comprising: (a) a pipe; (b) a valve attached to one end of the pipe and in fluid communication therewith; (c) a seal having a bore therethrough, the pipe positioned in and sealed to the bore of the seal; (d) a first pipe connector having a bore therethrough, the pipe positioned through and sealed to the bore of the first pipe connector at a position of the pipe between the valve and the seal; (e) a bushing having a bore therethrough, at least a portion of the bore being threaded, the pipe being positioned in the bore of the bushing between the first pipe connector and the seal, the first pipe connector being a first pipe fitting having external threads thereon, said threads being substantially coaxial with the bore of the pipe fitting, the threaded portion of the bore of the bushing being dimensioned to engage with the external threads of the first pipe fitting, a second pipe connector having a bore therethrough and external threads thereon substantially coaxial with said bore, the pipe positioned through and sealed to the bore of the second pipe connector at a position of the pipe between the seal and the first pipe connector, wherein the seal has the shape of a bored sphere and wherein the seal comprises an elastomer.

2. Apparatus suitable for use in waste line plumbing applications, comprising: (a) a pipe; (b) a valve attached to one end of the pipe and in fluid communication therewith; (c) a seal having a bore therethrough, the pipe positioned in and sealed to the bore of the seal; (d) a first pipe connector having a bore therethrough, the pipe positioned through and sealed to the bore of the first pipe connector at a position of the pipe between the valve and the seal; (e) a bushing having a bore therethrough, at least a portion of the bore being threaded, the pipe being positioned in the bore of the bushing between the first pipe connector and the seal, the first pipe connector being a first pipe fitting having external threads thereon, said threads being substantially coaxial with the bore of the pipe fitting, the threaded portion of the bore of the bushing being dimensioned to engage with the external threads of the first pipe fitting, a second pipe connector having a bore therethrough and external threads thereon substantially coaxial with said bore, the pipe positioned through and sealed to the bore of the second pipe connector at a position of the pipe between the seal and the first pipe connector, wherein the seal has the shape of a bored externally ribbed cylinder and wherein the seal comprises an elastomer.

* * * * *